US006018819A

United States Patent [19]

King et al.

[11] Patent Number: 6,018,819

[45] Date of Patent: Feb. 1, 2000

[54] GARMENT WITH MOISTURE VAPOR TRANSMISSIVE WIND BARRIER PANELS

[75] Inventors: James C. King, Leawood, Kans.; Frederic T. Wilson, Elkton, Md.

[73] Assignee: BHA Technologies, Inc., Kansas City, Mo.

[21] Appl. No.: 09/060,623

[22] Filed: Apr. 15, 1998

[51] Int. Cl.[7] ..... A41D 3/04; A41D 11/00

[52] U.S. Cl. ..... 2/69; 2/82; 2/87; 2/97; 2/904

[58] Field of Search ..... 2/69, 82, 87, 97, 2/272, 904, DIG. 5, 159; 428/171, 196; 174/102

[56] References Cited

U.S. PATENT DOCUMENTS

| | | | |
|---|---|---|---|
| 4,187,390 | 2/1980 | Gore | 174/102 |
| 4,302,496 | 11/1981 | Donovan | 428/196 |
| 4,513,451 | 4/1985 | Brown . | |
| 4,783,858 | 11/1988 | Chevalier . | |
| 4,807,303 | 2/1989 | Mann et al. . | |
| 4,843,647 | 7/1989 | Phillips, Sr. et al. . | |
| 5,088,116 | 2/1992 | Gould . | |
| 5,102,711 | 4/1992 | Keller et al. | 428/71 |
| 5,159,716 | 11/1992 | Takata . | |
| 5,282,277 | 2/1994 | Onozawa . | |
| 5,290,628 | 3/1994 | Lim et al. . | |
| 5,498,472 | 3/1996 | Gold . | |
| 5,813,052 | 9/1998 | Taylor | 2/114 |
| 5,822,795 | 10/1998 | Gold | 2/159 |

OTHER PUBLICATIONS

Performance Bicycle Catalog, Year End 1997, p. 2 Performance® Gore Windstopper® Vest and Pants.

Performance Bicycle Catalog, Year End 1997, p. 8 Performance® Triflex Tights.

Performance Bicycle Catalog, Winter Clearance 1998, p. A Pearl izumi® Zephyr Pro Vest, Pearl izumi® Classic Jacket.

Bike Nashbar Catalog 126, Fall, 1997, p. 4 Inmotion® Wyndtech Shirt.

Performance Bicycle Catalog, Winter Clearance 1998, p. E Performance™ Windvest.

Bike Nashbar Catalog 126, Fall 1997, p. 8 Windfront Tight.

Performance Bicycle Catalog, Year End 1997, p. 7 Performance® illumiNITE Wind Jacket & Vest.

*Primary Examiner*—John J. Calvert
*Assistant Examiner*—Robert Muromoto
*Attorney, Agent, or Firm*—Greg Strugalski

[57] ABSTRACT

A garment (20) for inhibiting relatively moving air from contacting a portion of a person wearing the garment. The garment (20) comprises a first panel (22) for inhibiting relative air movement contact against a portion of the body of the person. The first panel (22) includes a first fabric layer (62), a second fabric layer (64) and a first membrane (66) located between the first and second the first fabric layers. The first membrane (66) is water-resistant. The first panel (22) has an air permeability of not more than 3 CFM/ft$^2$ and a moisture vapor transmission rate of at least 800 gm/m$^2$·day. The garment (20) also comprises a second panel (24) connectable with the first panel (22). The second panel (24) includes a third fabric layer (62*a*), a fourth fabric layer (64*a*) and a second membrane (66*a*) located between the third and fourth fabric layers. The second membrane (66*a*) is water-resistant. The second panel (24) has an air permeability of at least 6 CFM/f$^2$ and a moisture vapor transmission rate of at least 1000 gm/m$^2$·day.

19 Claims, 4 Drawing Sheets

GARMENT WITH MOISTURE VAPOR TRANSMISSIVE WIND BARRIER PANELS

BACKGROUND OF THE INVENTION

1. Technical Field

The present invention relates generally to a garment and, in particular, to a moisture vapor transmissive, water-resistant and wind barrier garment suitable for use during physical activity.

2. Description of the Prior Art

It is known that during physical activity a person perspires. If the person wears a garment that is not moisture vapor transmissive, moisture in the form of perspiration is generally trapped within the garment and cannot escape to evaporate. If the person wears a garment which does not have wind barrier properties, air moving relative to the person, such as blowing wind, then passes through or enters garment the person can feel uncomfortably chilly or cold.

Known garments for use during physical activity are typically made from woven, knit or mesh fabric material, such as a cotton, polypropylene, nylon, polyester, Lycra® spandex or numerous other materials which permit perspiration from the person wearing the garment to escape and evaporate. However, a garment made from these types of known materials generally provides little or no protection from relatively moving air, wind or wind chill. Furthermore, a garment made of these known materials may undesirably absorb and retain moisture.

During physical activities such as bicycling, running, roller skating, skate boarding, skiing, ice skating, snow boarding, water sports, motorcycling and the like, relatively moving air is often encountered which can produce a wind chill effect. It is therefore desirable, when a person is exposed to relatively moving air, to wear a garment that can protect at least a portion of the person's body from contact with the relatively moving air and thereby minimize wind chill. For maximum comfort during physical activity, it is also desirable to wear a garment that is moisture vapor transmissive. Such a moisture vapor transmissive garment allows a relatively large amount of moisture in the form of sweat to escape from within the garment and evaporate.

Wind barrier garments for use while engaging in physical activity or when exposed to relatively moving air are known. Typically, the known wind barrier garments are made entirely from a material with properties to protect the wearer covered by the garment from contact with relatively moving air. Such material may also be moisture vapor transmissive to some extent but generally lacks air permeability which can cause a warm sensation and thereby increase the rate of perspiration which further increases the amount of perspiration trapped within the garment.

Alternatively, structures have been added to a garment which are formed from a material capable of blocking relatively moving air from passing through the structures and entering the garment. These structures could be removable or permanently attached to the garment. The material of these structures tends to lack moisture vapor transmissivity which could render the garment susceptible to retaining moisture within the garment. The material of these structures also tend to lack air permeability which can cause the wearer, in certain circumstances, to feel uncomfortably warm.

Vents may be incorporated in the garment and selectively opened or closed. For example, vents commonly referred to as "pit zips" have been incorporated to allow some cooling air into the garment when opened. Other attempts at increasing ventilation in a garment involve using a wind barrier fabric in one area, generally the front, a mesh material in the back or vents that may be selectively opened and closed. The vents and mesh are air permeable but offer little protection from water in the form of rain and wind.

SUMMARY OF THE INVENTION

The present invention provides a garment made from material that is moisture vapor transmissive, water-resistant and inhibits relatively moving air from contacting at least a portion of a person wearing the garment. The garment may be embodied in the form of a vest, jacket, pair of pants and the like. The garment comprises a first panel including a water-resistant and moisture vapor transmissive first film. The first panel inhibits relatively moving air from contacting against at least a portion of the body of the person. The first panel has an air permeability of not more than 3 CFM/ft$^2$ and a moisture vapor transmission rate of at least 800 gm/m$^2$·day. The garment comprises a second panel including a water-resistant and moisture vapor transmissive second film. The second panel has an air permeability of at least 6 CFM/ft$^2$ and a moisture vapor transmission rate of at least 1000 gm/m$^2$·day.

At least one of the first and second films is a microporous membrane. The microporous membrane is made from an expanded polytetrafluoroethylene (ePTFE) material. At least one of the first and second panels further includes a fabric layer overlying at least a respective one of the first and second films. The first panel is adapted to cover a portion of a person, such as the front, exposed to relative air movement. The second panel is adapted to cover a portion of the back of a person wearing the garment.

The first panel includes a first fabric layer and a second fabric layer. The first film is a membrane located between the first and second fabric layers. At least one of the first and second fabric layers is attached to the membrane. The second panel includes a third fabric layer and a fourth fabric layer. The second film is a membrane located between the third and fourth fabric layers. At least one of the third and fourth fabric layers is attached to the membrane.

The second panel is connectable with the first panel. The garment includes a pair of sides. The first panel is connected with the second panel in at least one location per side. The first panel may be connected with the second panel in at least two locations per side. The garment may further include a third panel disposed between and attached to the first and second panels in at least one location per side.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENTS

Figure 4:
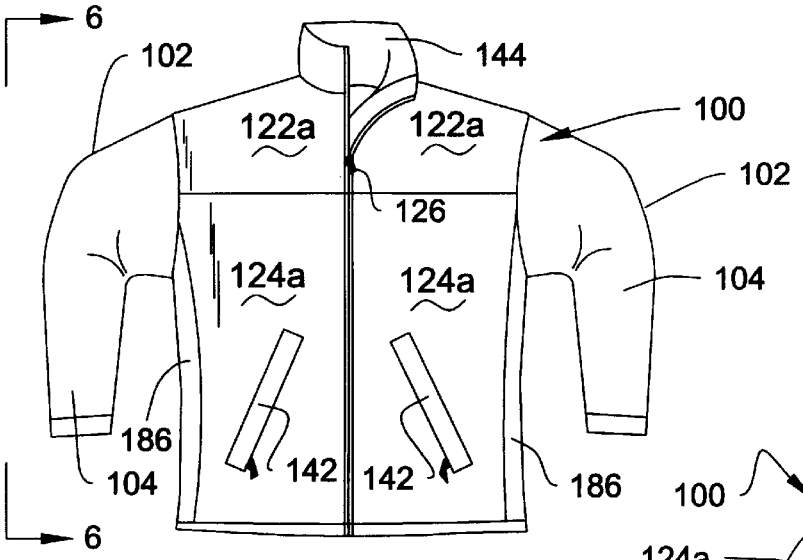
FIG. 4 is a front view of another garment of the present invention embodied as a jacket.
Figure 6:
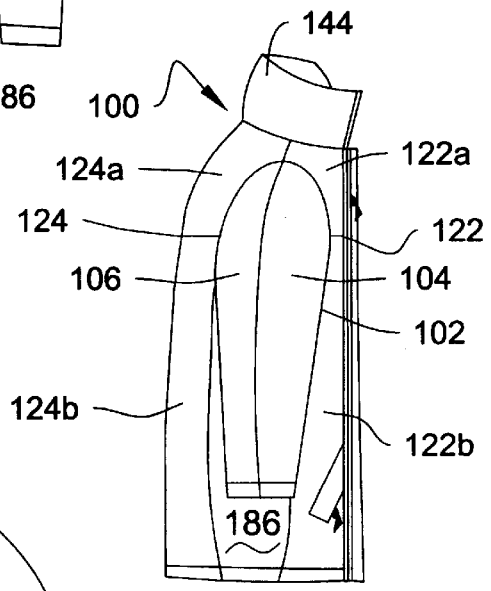
FIG. 6 is a side view of the jacket in FIG. 4, taken along the line 6—6 in FIG. 4.
Figure 5:
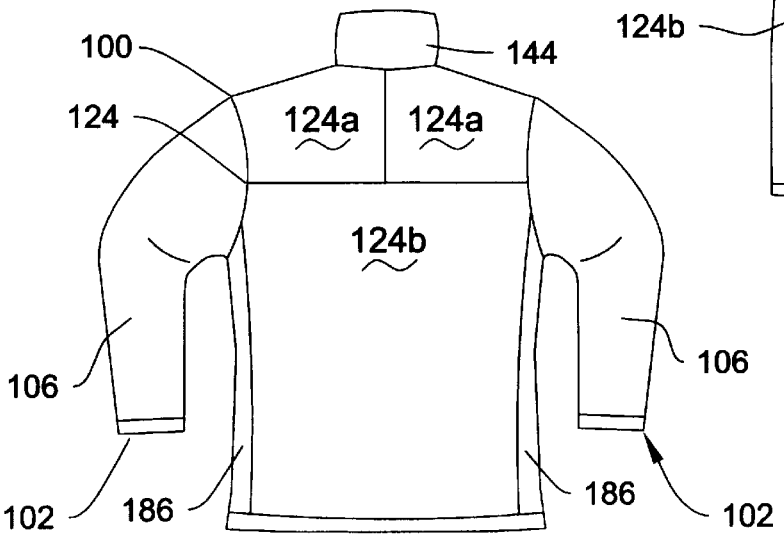
FIG. 5 is a back view of the jacket in FIG. 4.
Figure 7:
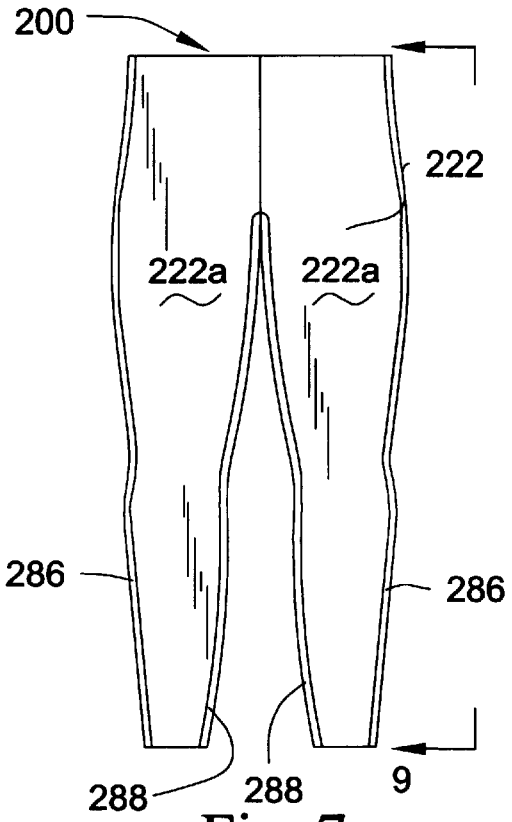
FIG. 7 is a front view of another garment of the present invention embodied as a pair of pants.
Figure 8:
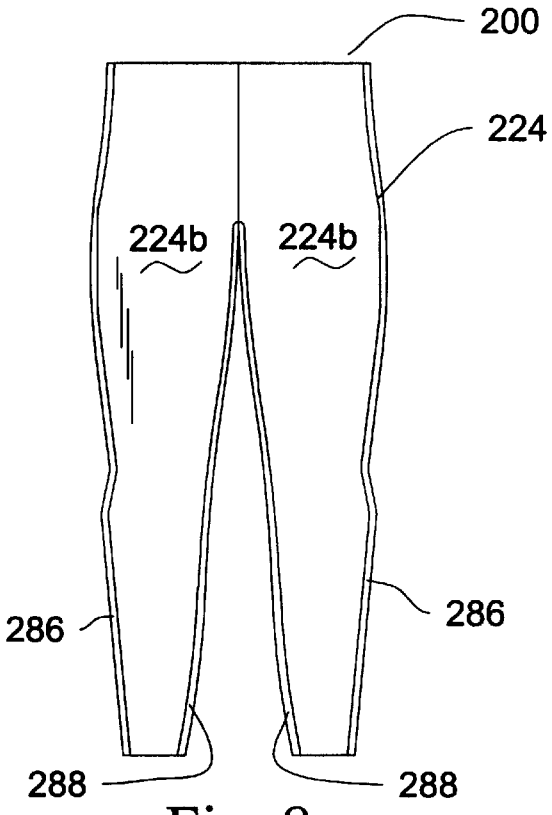
FIG. 8 is a back view of the pants in FIG. 7.
Figure 9:
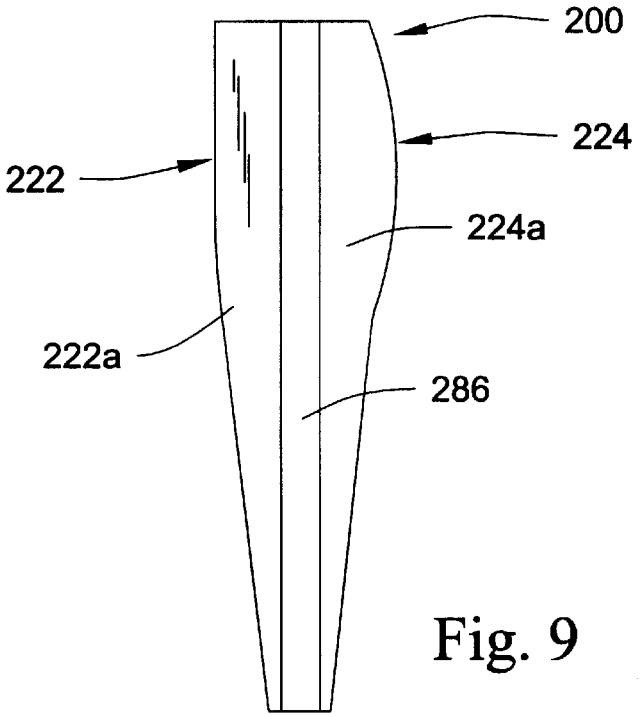
FIG. 9 is a side view of the pants in FIG. 7, taken along the line 9—9 in FIG. 7.

A garment embodying the present invention is illustrated as a vest 20 (FIGS. 1–3), jacket 100 (FIGS. 4–6) and pair of pants 200 (FIGS. 7–9). The illustrated embodiments are not intended to limit the scope of the present invention because other uses such as hats, gloves, socks, leggings, caps, shoes, boots and the like are also contemplated. The garment of the present invention is particularly suitable for wearing during physical activity and when the person wearing the garment is exposed to relative air movement that could promote a wind chill effect.

Figure 2:
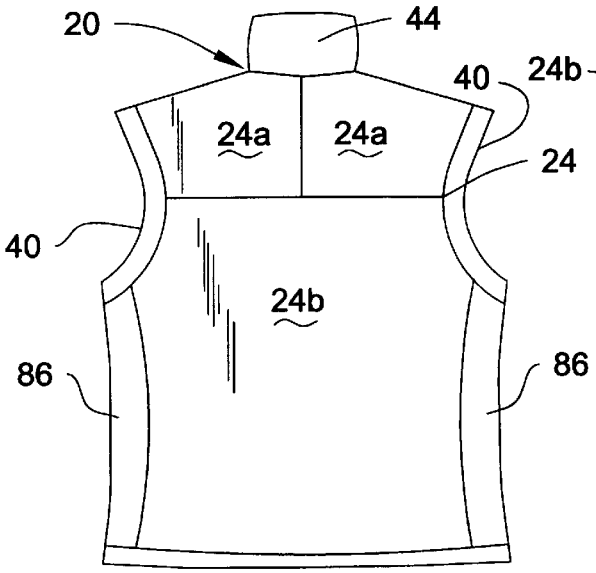
FIG. 2 is a back view of the vest in FIG. 1.
Figure 3:
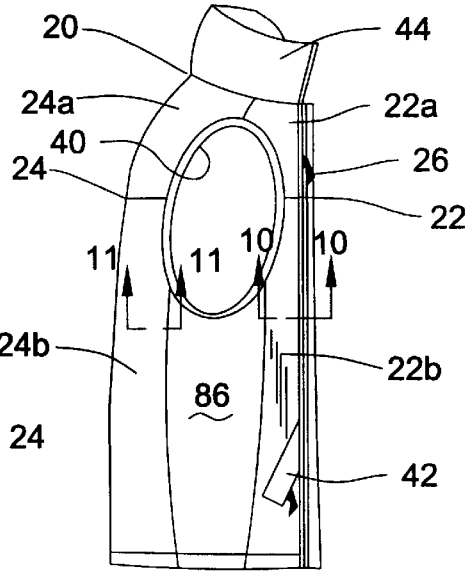
FIG. 3 is a side view of the vest in FIG. 1, taken along the line 3—3 in FIG. 1.

The garment embodied as the vest 20 (FIGS. 1–3) is constructed to inhibit relatively moving air from contacting at least a portion of a person wearing the vest while being moisture vapor transmissive and water-resistant. The vest 20 includes a wind proof front panel 22 (FIGS. 1 and 3) and a rear panel 24 (FIGS. 2 and 3). The front panel 22 is adapted to cover at least a portion of the front upper torso of a person wearing the vest 20. The rear panel 24 is adapted to cover at least a portion of the back upper torso of a person wearing the vest 20.

The vest 20 is divided into a pair of equal sized sides by a mid-plane M of the vest. Each side of the front panel 22 of the vest 20 includes an upper front panel portion 22*a* and a lower front panel portion 22*b*. It will be apparent that any number of front panel portions 22*a* and 22*b* may be utilized in the front panel 22 as is appropriate for performance, manufacture and style of the vest 20. The upper front panel portion 22*a* on each side of the vest 20 is attached to the lower front panel portion 22*b* in an appropriate manner, such as by sewing.

The front panel 22 of the vest 20 includes a full-length zipper 26. However, it will be apparent that the vest 20 can be in the form of a pullover or button front. The vest 20 may optionally include a wind flap (not shown) adjacent the zipper 26. The vest 20 has a pair of armholes 40. Each armhole 40 may receive an arm of the wearer. The vest 20 also includes a pair of pockets 42. Each pocket 42 is located on a respective side of the front panel 22 of the vest 20 and includes a wind flap. The vest 20 includes a collar 44 to extend around the neck of the person wearing the vest. It will be apparent that the vest 20 may include a collar of another design or no collar at all.

The rear panel 24 (FIGS. 2 and 3) of the vest 20 has a relatively high air permeability to maximize comfort of the person wearing the vest. The rear panel 24 includes two upper rear panel portions 24*a* and a single lower rear panel portion 24*b*. It will be apparent that any number of rear panel portions 24*a* and 24*b* may be utilized in the rear panel 24 that is appropriate. For example, a single upper rear panel portion 24*a* may be used or a pair of lower rear panel portions 24*b* may be used. The upper rear panel portions 24*a* are attached to each other and to the lower rear panel portion 24*b* in an appropriate manner, such as by sewing. Each upper rear panel portion 24*a* is attached to a respective upper front panel portion 22*a* at the top of the vest 20 between a respective armhole 40 and the collar 44 in an appropriate manner, such as by sewing. Each lower front panel portion 22*b* is connected with the lower back portion 24*b* at the lateral sides of the vest 20 in a region below the armhole 40.

Figure 10:
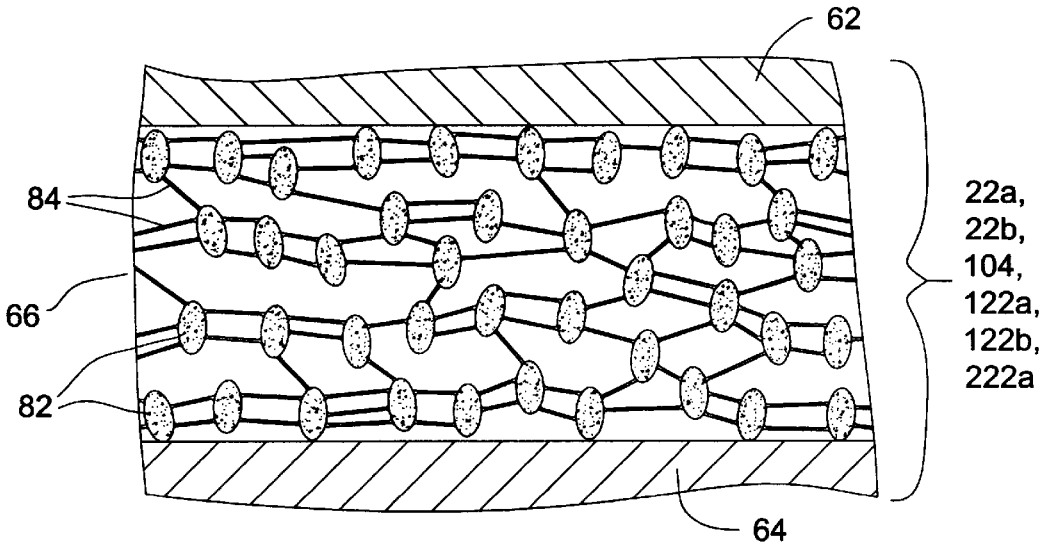
FIG. 10 is a schematic cross-sectional view of a panel used in the garments of FIGS. 1–9, taken approximately along line 10—10 in FIG. 3.
Figure 11:
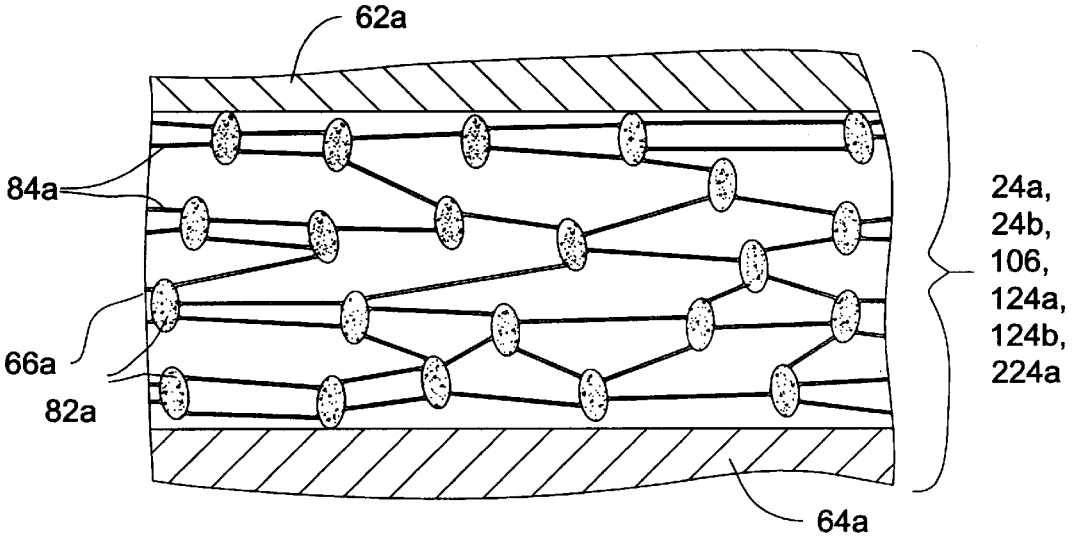
FIG. 11 is a schematic cross-sectional view of another fabric panel used in the garments of FIGS. 1–9, taken approximately along line 11—11 in FIG. 3.

Each of the front and rear panel portions 22*a*, 22*b*, 24*a* and 24*b* of the vest 20 is made from three layers of material, as viewed in FIGS. 10 and 11. It will be apparent that any suitable number of layers may make up the front and rear panel portions 22*a*, 22*b*, 24*a* and 24*b*. Each front panel portion 22*a* and 22*b* (FIGS. 1, 3 and 10) of the vest 20 includes an outer shell 62 (FIG. 10) made from any suitable fabric material, such as fleece, microfleece, nylon or polyester rip stop or plain weave. The outer shell 62 may have a durable water repellency (DWR) treatment applied. Each front panel portion 22*a* and 22*b* also includes an inner liner 64 made from any suitable fabric material, such as knitted tricot, mesh, woven nylon or a flocked or non-woven material. Each front panel portion 22*a* and 22*b* also includes a moisture vapor transmissive film, preferably in the form of a hydrophobic microporous membrane 66 located between the outer shell 62 and the inner liner 64. It will be apparent that the film could be made from any suitable material, such as a polyurethane-based material.

The membrane 66 used in the front panel portions 22*a* and 22*b* is preferably made from an expanded polytetrafluoroethylene (ePTFE) material having a three dimensional structure of nodes 82 interconnected by fibrils 84. The membrane 66 is wind proof, water-resistant and moisture vapor transmissive. The membrane 66 is made to serve primarily as a wind barrier component of the front panel portions 22*a* and 22*b*.

It will be appreciated that the production of the membrane 66 is a complex process. Control of the thickness of the membrane 66 and the size, density, distribution and orientation among other parameters of the nodes 82 and fibrils 84 establish the moisture vapor transmissivity, air permeability, water-resistance and other physical characteristics of the membrane 66 and, thus, the front panel portions 22*a* and 22*b*. Testing the fabric of the front and rear panel portions 22*a*, 22*b*, 24*a* and 24*b* is performed in accordance with industry accepted standards to assure that desired physical characteristics are achieved so the vest 20 performs as intended. Air permeability of the panels is tested per ASTM D737-96. For purposes of the present invention, "wind proof" is defined as having an air permeability of not more than 3 CFM/ft$^2$. Water or Moisture Vapor Transmission Rate (MVTR) of the panels is tested per ASTM E96B-94. Water Repellency or Resistance of the panels is tested per AATCC 22-1996 and 127-1995.

The membrane 66 is made so each front panel portion 22*a* and 22*b* has an air permeability of not more than 3 CFM/ft$^2$ to qualify as wind proof and preferably not more than 1 CFM/ft$^2$. The membrane 66 is also made so each front panel portion 22*a* and 22*b* has a moisture vapor transmission rate of at least 800 gm/m$^2$·day and preferably at least 1200 gm/m$^2$·day. The membrane 66 is made so the front panel portions 22*a* and 22*b* qualify as water-resistant. Thus, the front panel 22 permits moisture vapor in the form of perspiration to readily escape from within the vest 20 and evaporate while serving as a water-resistant wind barrier.

The outer shell 62 and inner liner 64 of the front panel portions 22*a* and 22*b* overlie substantially all of respective opposite major side surfaces of the membrane 66. The outer shell 62, inner liner 64 and membrane 66 are connected together in a suitable manner, such as being sewn, sealed or laminated by an adhesive or heat. It will be apparent that the two of the three layers could be laminated and the third layer be sewn to the other two laminated layers around a peripheral edge of a front panel portion 22*a* or 22*b*.

Figure 1:
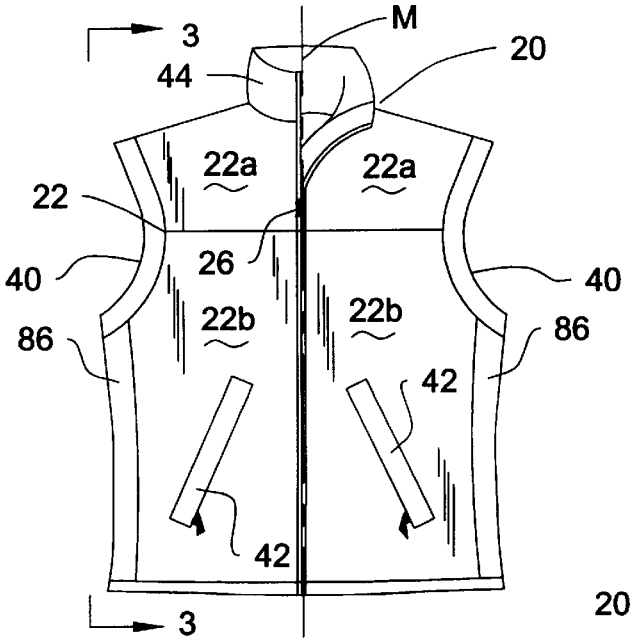
FIG. 1 is a front view of a garment of the present invention embodied as a vest.

Each rear panel portion 24*a* and 24*b* (FIGS. 2, 3 and 11) of the vest 20 is constructed similar to the front panel portions 22*a* and 22*b* (FIGS. 1, 3 and 10). Each rear panel portion 24*a* and 24*b* includes an outer shell 62*a* (FIG. 11) made from any suitable fabric material, such as fleece, micro-fleece, nylon or polyester rip stop or plain weave. The outer shell 62*a* is preferably the same material as the outer shell 62 (FIG. 10) but does not necessarily have to be the same. The outer shell 62*a* may have a durable water repellency (DWR) treatment applied. The rear panel 24 also includes an inner liner 64*a* made from any suitable fabric material, such as knitted tricot, mesh or woven nylon. The inner liner 64*a* is preferably the same material as the inner liner 64 (FIG. 10) but does not necessarily have to be the same. Each of the rear panel portions 24*a* and 24*b* further includes a moisture vapor transmissive film, preferably in the form of a hydrophobic microporous membrane 66*a* located between the outer shell 62*a* and the inner liner 64*a*. It will be apparent that the film could be made from any suitable material, such as a polyurethane-based material.

The membrane 66*a* in each of the rear panel portions 24*a* and 24*b* is preferably made from an expanded polytetrafluoroethylene (ePTFE) material having a three dimensional structure of nodes 82*a* interconnected by fibrils 84*a*. The membrane 66*a* is made so at least one of the characteristics, such as the thickness of the membrane and size, density, distribution and orientation of the nodes 82*a* and fibrils 84*a* is different than in the membrane 66 (FIG. 10). This different characteristic of the membrane 66*a* provides at least one different property of the rear panel portions 24*a* and 24*b*, such as air permeability, different from the front panel portions 22*a* and 22*b*. The membrane 66*a* is made to serve primarily as a moisture vapor transmissive, water-resistant and relatively high air permeable component of the rear panel portions 24*a* and 24*b*. The relatively higher air permeability of the rear panel portions 24*a* and 24*b* compared to the front panel portions 22*a* and 22*b* is accomplished during manufacture of the membrane 66*a* by varying manufacturing parameters and during lamination, if the rear panel portions are laminated.

The membrane 66*a* is made so the rear panel portions 24*a* and 24*b* have an air permeability of at least 6 CFM/ft$^2$ and preferably less than about 30 CFM/ft$^2$. The membrane 66*a* (FIG. 11) is more air permeable than the membrane 66 (FIG. 10) so it permits enhanced cooling and comfort of the person wearing the vest 20 by allowing a predetermined amount of air to pass through the rear panel 24 yet still resist water penetration from the outside. It is determined that the rear panel 24 does not need the wind barrier properties of the front panel 22 but that it is desirable to have relatively more air pass through the rear panel for cooling during physical activity. The membrane 66*a* is also made so each of the rear panel portions 24*a* and 24*b* has a moisture vapor transmission rate of at least 1000 gm/m$^2$·day and preferably 1500 gm/m$^2$·day. The rear panel 24 permits moisture vapor in the form of perspiration to readily escape from within the vest 20 and evaporate.

The outer shell 62*a* and inner liner 64*a* of the rear panel portions 24*a* and 24*b* overlie substantially all of respective opposite major side surfaces of the membrane 66*a*. The outer shell 62*a*, inner liner 64*a* and membrane 66*a* are connected together in a suitable manner, such as being sewn, sealed or laminated by an adhesive or heat. It will be apparent that the two of the three layers could be laminated and the third layer sewn to the other two laminated layers around a peripheral edge of a rear panel portion.

Optionally the upper rear panel 24*a* has an air permeability of at least 6 CFM/ft$^2$ and the lower rear panel 24*b* has an air permeability of at least 10 CFM/ft$^2$. The vest 20 may include an optional side panel 86 on each side which is located between and attached to the lower front panel portion 22*b* and the lower rear panel portion 24*b*. The side panel 86 is preferably made from a stretchable material that would retain the front panel 22 and rear panel 24 against a wearer's body without discomfort. The side panel 86 may be of any appropriate size and may include a moisture vapor permeable microporous membrane.

The garment embodied as the jacket 100 (FIGS. 4–6) is constructed to inhibit relatively moving air from contacting a portion of a person wearing the jacket while being moisture vapor transmissive and water-resistant. The jacket 100 is constructed similar to the vest 20 (FIGS. 1–3) with the addition of sleeves 102. Each sleeve 102 of the jacket includes a front sleeve panel 104 and a rear sleeve panel 106. The front sleeve panel 104 on each sleeve 102 is attached to the rear sleeve panel 106 in an appropriate manner, such as by sewing. The front sleeve panel 104 is adapted to cover a portion of the front of a person's arm wearing the jacket. The rear sleeve panel 106 is adapted to cover a portion of the back of a person's arm wearing the garment.

The jacket 100 (FIG. 4) also includes a front panel 122 and a rear panel 124. The jacket 100 is divided into a pair of sides by a mid-plane (not shown) of the jacket. The front panel 122 is connected to the rear panel 124 in at least one location per side. The sleeves 102 are attached to the front panel 122 and rear panel 124 in an appropriate manner, such as by sewing. Each front and rear sleeve panel 104 and 106 of the sleeves 102 is constructed from three layers of material, as viewed in FIGS. 10 and 11. It will be apparent that any suitable number of layers may comprise the front and rear sleeve panels 104 and 106.

Each front sleeve panel 104 (FIGS. 4, 6 and 10) is constructed in a similar manner to the front panel portions 22*a* and 22*b* of the vest 20 (FIGS. 1 and 3). Each front sleeve panel 104 includes an outer shell 62 (FIG. 10) made from any suitable fabric material, such as fleece, micro-fleece, nylon or polyester rip stop or plain weave. The outer shell 62 may have a durable water repellency (DWR) treatment applied. The front sleeve panels 104 also include an inner liner 64 made from any suitable fabric material, such as knitted tricot, mesh or woven nylon. The front sleeve panels 104 further include a hydrophobic microporous membrane 66 located between the outer shell 62 and the inner liner 64.

The membrane 66 in the front sleeve panels 104 is preferably made from an expanded polytetrafluoroethylene (ePTFE) material having a three dimensional structure of nodes 82 interconnected by fibrils 84. The membrane 66 is wind proof, water-resistant and moisture vapor transmissive. The membrane 66 serves primarily as a moisture vapor transmissive wind barrier component of the front sleeve panels 104.

The membrane 66 is made so the front sleeve panels 104 have an air permeability of not more than 3 CFM/ft$^2$ to qualify as wind proof. The membrane 66 is also made so each front sleeve panel 104 has a moisture vapor transmission rate of at least 800 gm/m$^2$·day and preferably at least 1200 gm/m$^2$·day. The membrane 66 is also made so the front sleeve panels 104 qualify as water-resistant.

Each rear sleeve panel 106 (FIGS. 4 and 5) is constructed similar to the front sleeve panels 104 and the rear panel portions 24*a* and 24*b* (FIGS. 1 and 3) of the vest 20. Each of the rear sleeve panels 106 includes an outer shell 62*a* (FIG. 11) made from any suitable fabric material, such as fleece, micro-fleece, nylon or polyester rip stop or plain weave. The outer shell fabric 62*a* is preferably the same material as the outer shell fabric 62 (FIG. 10) but does not necessarily have to be the same. The outer shell fabric 62*a* may have a durable water repellency (DWR) treatment applied.

Each rear sleeve panel 106 also includes an inner liner 64*a* made from any suitable fabric material, such as knitted tricot, mesh or woven nylon. The inner liner 64*a* is preferably the same material as the inner liner 64 (FIG. 10) but does not necessarily have to be the same. Each rear sleeve panel 106 further includes a hydrophobic microporous membrane 66*a* located between the outer shell 62*a* and the inner liner 64*a*.

The membrane 66*a* in each rear sleeve panel 106 is made from an expanded polytetrafluoroethylene (ePTFE) material having a three dimensional structure of nodes 82*a* interconnected by fibrils 84*a*. The membrane 66*a* is made to serve primarily as a moisture vapor transmissive, water-resistant and relatively high air permeable component of the rear sleeve panels 106.

The outer shell 62*a* and inner liner 64*a* substantially overlie the opposite major side surfaces of the membrane 66*a*. The outer shell 62*a*, inner liner 64*a* and membrane 66*a* are connected together in a suitable manner, such as being sewn, sealed or laminated by an adhesive or heat. Optionally, the membrane 66*a* is made so the rear sleeve panels 106 have an air permeability greater than about 10 CFM/ft$^2$.

The membrane 66*a* is made so the rear sleeve panels 106 have an air permeability of at least 6 CFM/ft$^2$. The membrane 66*a* is also made so each of the rear sleeve panels 106 has a moisture vapor transmission rate of at least 1000 gm/m$^2$·day and preferably at least 1500 gm/m$^2$·day. The relatively higher air permeability of the rear sleeve panels 106 compared to the front sleeve panels 104 is accomplished during manufacture of the membrane 66*a* by varying manufacturing parameters and during lamination, if the rear sleeve panels are laminated. The membrane 66*a* (FIG. 11) is more air permeable than the membrane 66 (FIG. 10) so it permits cooling of the person wearing the jacket 100 by permitting air to pass through the rear sleeve panels 106 and resist water penetration from the outside. It is determined that the rear sleeve panels 106 do not need the wind barrier properties of the front sleeve panels 104 but is desirable to have more air pass through the rear sleeve panels for cooling during periods of physical activity.

Each side of the front panel 122 of the jacket 100 includes an upper front panel portion 122*a* and a lower front panel portion 122*b*. It will be apparent that any number of front panel portions 122*a* and 122*b* may be utilized in the front panel 122 as is appropriate for performance, manufacture and style of the jacket 100. The upper front panel portion 122*a* on each side of the jacket 100 is attached to the lower front panel portion 122*b* in an appropriate manner, such as by sewing.

The front panel 122 of the jacket 100 is adapted to cover at least a portion of the front of a person wearing the jacket. The rear panel 124 of the jacket 100 is adapted to cover at least a portion of the back of a person wearing the jacket. The jacket 100 includes a zipper 126. However, it is contemplated that the jacket 100 can be in the form of a pullover or button front. The jacket 100 may optionally include a wind flap (not shown) which may be on the interior or exterior of the jacket. The jacket 100 also includes a pair of pockets 142. Each pocket 142 is located on a side of the jacket 100 in front and has a wind flap. The jacket 100 includes a collar 144.

The rear panel 124 of the jacket 100 includes two upper rear panel portions 124*a* and a single lower rear panel portion 124*b*. It will be apparent that any number of rear panel portions 124*a* and 124*b* may be utilized in the rear panel 124 that is appropriate. The upper rear panel portions 124*a* are attached to the lower rear panel portion 124*b*

Each of the front and rear panel portions 122*a*, 122*b*, 124*a* and 124*b* is constructed from three layers of material, as viewed in FIGS. 10 and 11. It will be apparent that any suitable number of layers may comprise the front and rear panel portions 122*a*, 122*b*, 124*a* and 124*b*.

Each front panel portion 122*a* and 122*b* (FIGS. 4, 6 and 10) is made similar to the front panel portions 22*a* and 22*b* of the vest 20 (FIGS. 1 and 3). Each front panel portion 122*a* and 122*b* includes an outer shell 62 (FIG. 10) made from any suitable fabric material, such as fleece, micro-fleece, nylon or polyester rip stop or plain weave. The outer shell 62 may have a durable water repellency (DWR) treatment applied. Each front panel portion 122*a* and 122*b* also includes an inner liner 64 made from any suitable fabric material, such as knitted tricot, mesh or woven nylon. Each front panel portion 122*a* and 122*b* further includes a hydrophobic microporous membrane 66 located between the outer shell 62 and the inner liner 64.

The membrane 66 in the front panel portions 122*a* and 122*b* is preferably made from an expanded polytetrafluoroethylene (ePTFE) material having a three dimensional structure of nodes 82 interconnected by fibrils 84. The membrane 66 is wind proof, water-resistant and moisture vapor transmissive. The membrane 66 is made to serve primarily as a moisture vapor transmissive wind barrier component of the front panel portions 122*a* and 122*b* of the jacket 100.

The membrane 66 is selected so the front panel portions 122*a* and 122*b* have an air permeability of not more than 3 CFM/ft$^2$ to qualify as wind proof. The membrane 66 is also selected so each front panel portion 22*a* and 22*b* has a moisture vapor transmission rate of at least 800 gm/m$^2$·day and preferably at least 1200 gm/m$^2$·day.

Each of the rear panel portions 124*a* and 124*b* (FIGS. 5, 6 and 11) is constructed similar to the front panel portions 122*a* and 122*b* (FIGS. 4, 6 and 10) and rear panel portions 24*a* and 24*b* of the vest 20 (FIGS. 1–3). Each rear panel portion 124*a* and 124*b* includes an outer shell 62*a* (FIG. 11) made from any suitable fabric material, such as fleece, microfleece, nylon or polyester rip stop or plain weave. The outer shell 62*a* is preferably the same material as the outer shell 62 (FIG. 10) but does not necessarily have to be the same. The outer shell 62*a* may have a durable water repellency (DWR) treatment applied.

Each rear panel portion 124 includes an inner liner 64*a* made from any suitable fabric material, such as knitted tricot, mesh or woven nylon. The inner liner 64*a* is preferably the same material as the inner liner 64 (FIG. 10) but does not necessarily have to be the same. Each of the rear panel portions 124*a* and 124*b* further includes a hydrophobic microporous membrane 66*a* located between the outer shell 62*a* and the inner liner 64*a*.

The membrane 66*a* in each rear panel portion 124*a* and 124*b* is made from an expanded polytetrafluoroethylene (ePTFE) material having a three dimensional structure of nodes 82*a* interconnected by fibrils 84*a*. The membrane 66*a* is made to serve primarily as a moisture vapor transmissive, water-resistant and relatively high air permeable component of the rear panel portions 124*a* and 124*b*.

The membrane 66*a* is made so the rear panel portions 124*a* and 124*b* has an air permeability of at least 6 CFM/ft$^2$. The membrane 66*a* is also made so each of the rear panel portions 124*a* and 124*b* have a moisture vapor transmission rate of at least 1000 gm/m$^2$·day and preferably at least 1500 gm/m$^2$·day. This relatively higher air permeability of the rear panel portions 124*a* and 124*b* is accomplished during manufacture of the membrane 66*a* by controlling certain manufacturing parameters and during lamination of the rear panel portions 124*a* and 124*b*, if the rear panel portions are laminated. Thus, it is seen that the membrane 66*a* (FIG. 11) is more air permeable than the membrane (FIG. 10) so it will serve to let a person wearing the jacket 100 remain cool by permitting a predetermined amount of air to pass through it and resist water penetration. It is determined that the rear panel 124 does not need the wind barrier properties of the front panel 122 but is desirable to have more air permeability for cooling, especially during physical activity.

Optionally, the upper rear panel 124*a* may have an air permeability of at least 6 CFM and the lower rear panel 124*b* at least 10 CFM. The jacket 100 may also have an optional side panel 186 located between and attached to the front panel portion 122*b* and rear panel portion 124*b*. The side panel 186 may be made from a stretchable material that would retain the front panel and rear panel against a wearer's body without discomfort, such as a spandex material.

The garment embodied as the pair of pants 200 (FIGS. 7–9) is constructed to inhibit the relative movement of air from contacting a portion of a person wearing the pants while being moisture vapor transmissive and water-resistant. The pants 200 include front panel 222 and a rear panel 224. The pants 200 have a pair of opposite sides relative to a midplane (not shown) of the pants. The front panel 222 of the pants 200 is made of a single front panel portion 222*a* located on each side of the pants. It will be apparent that any number of front panel portions 222*a* may be utilized that is appropriate for performance, manufacture and style of the pants 200. The front panel portions 222*a* are connected together adjacent the mid-plane in an appropriate manner, such as by sewing. The front panel 222 is adapted to cover at least a portion of the front of a person wearing the pants 200.

The rear panel 224 of the pants 200 is made of a single rear panel portion 224*a* located on each side of the pants. The rear panel portions 224*a* are connected together adjacent the mid-plane in an appropriate manner, such as by sewing. It will be apparent that any number of rear panel portions 224*a* may be utilized that is appropriate. The rear panel 224 is adapted to cover at least a portion of the back of a person wearing the pants 200. The front panel 222 is connected with the rear panel 224 in at least one location per side. The pants 200 preferably have an elastic waistband to hold the pants in place.

Each of the front and rear panel portions 222*a* and 224*a* is preferably constructed from three layers of material, as viewed in FIGS. 10 and 11, respectively. It will be apparent that any suitable number of layers may comprise the front and rear panel portions 222*a* and 224*a* of the pants 200.

Each front panel portion 222*a* (FIGS. 7, 9 and 10) of the pants 200 is made in a similar manner to the front panel portions 22*a* and 22*b* of the vest 20 (FIGS. 1 and 3). Each front panel portion 222*a* (FIGS. 7 and 9) includes an outer shell 62 (FIG. 10) made from any suitable fabric material, such as fleece, micro-fleece, nylon or polyester rip stop or plain weave. The outer shell 62 may have a durable water repellency (DWR) treatment applied. Each front panel portion 222*a* of the pants 200 also includes an inner liner 64 made from any suitable fabric material, such as knitted tricot, mesh or woven nylon. Each front panel portion 222*a* further includes a hydrophobic microporous membrane 66 located between the outer shell 62 and the inner liner 64. The outer shell 62 and inner liner 64 overlie substantially all of the respective opposite major side surfaces of the membrane 66.

The membrane 66 in the front panel portions 222*a* is made from an expanded polytetrafluoroethylene (ePTFE) material having a three dimensional structure of nodes 82 interconnected by fibrils 84. The membrane 66 is wind proof, water-resistant and moisture vapor transmissive. The membrane 66 is made to serve primarily as a moisture vapor transmissive wind barrier component of the front panel 222 of the pants.

The membrane 66 is made so the front panel 222 of the pants 200 has an air permeability of not more than 3 CFM/ft$^2$ to qualify as wind proof from the front of the pants 200 and protect the front of the person's body from wind chill. The membrane 66 is also selected so the front panel 222 has a moisture vapor transmission rate of at least 800 gm/m$^2$·day and preferably at least 1200 gm/m$^2$·day.

Each rear panel portion 224*a* (FIGS. 8, 9 and 11) of the pants 200 is constructed in a similar manner to the front panel portions 222*a* (FIGS. 7, 9 and 10) and rear panel portions 22*a* and 22*b* of the vest 20 (FIGS. 2 and 3). Each rear panel portion 224*a* includes an outer shell 62*a* (FIG. 11) made from any suitable fabric material, such as fleece, micro-fleece, nylon or polyester rip stop or plain weave. The outer shell 62*a* is preferably the same material as the outer shell 62 (FIG. 10) but does not necessarily have to be the same. The outer shell 62*a* may have a durable water repellency (DWR) treatment applied. Each rear panel portion 224*a* includes an inner liner 64*a* made from any suitable fabric material, such as knitted tricot, mesh or woven nylon. The inner liner 64*a* is preferably the same material as the inner liner 64 (FIG. 10) but does not necessarily have to be the same. Each rear panel portion 224*a* further includes a hydrophobic microporous membrane 66*a* located between the outer shell 62*a* and the inner liner 64*a*. The outer shell 62*a* and inner liner 64*a* overlie substantially all of the respective opposite side surfaces of the membrane 66*a*.

The membrane 66*a* in each rear panel portion 224*a* is made from an expanded polytetrafluoroethylene (ePTFE) material having a three dimensional structure of nodes 82*a* interconnected by fibrils 84*a*. The membrane 66 is made to serve primarily as a moisture vapor transmissive, water-resistant and relatively high air permeable component of the rear panel 224. The membrane 66*a* is made so the rear panel 224 has an air permeability of at least 6 CFM/ft$^2$. The membrane 66*a* is also made so the rear panel 224 has a moisture vapor transmission rate of at least 1000 gm/m$^2$·day and preferably at least 1500 gm/m$^2$·day.

The relatively high air permeability of the rear panel portions 224*a* is accomplished during manufacture of the membrane 66*a* by controlling certain manufacturing parameters and during lamination, if the rear panel portions are laminated. The membrane 66*a* (FIG. 11) is more air permeable than the membrane 66 (FIG. 10) so it will serve to let a person wearing the pants 200 remain cool by permitting a predetermined amount of air to pass through the rear panel 224 of the pants and resist water penetration from the outside. It is determined that the rear panel 224 does not need the wind barrier properties of the front panel 222 but that it is desirable to have more air pass through it for cooling during physical activity.

Optionally the rear panel 224 may have an air permeability of at least 10 CFM. The pants 200 may also have a pair of optional outer side panels 286. Each outer side panel 286 is located between and attached to the front panel 222 and rear panel 224. The outer side panel 286 may be made from a stretchable material that would retain the front panel 222 and rear panel 224 against a wearer's body without discomfort. The pants 200 may also have a pair of optional inner side panels 288. Each inner side panel 288 is located between and attached to the front panel 222 and rear panel 224. The inner side panel 288 may be made from a stretchable material that would retain the front panel 222 and rear panel 224 against a wearer's body without discomfort.

From the above description of preferred embodiments of the invention, those skilled in the art will perceive improvements, changes and modifications. Such improvements, changes and modifications within the skill of the art are intended to be covered by the appended claims.

Having described at least one preferred embodiment of the invention, what is claimed is:

1. A garment for inhibiting the passage of relatively moving air through said garment, said garment comprising:

a first panel including a moisture vapor transmissive first hydrophobic microporous membrane, said first panel characterized by an air permeability of not more than 3 CFM/ft$^2$ and a moisture vapor transmission rate of at least 800 gm/m$^2$·day; and a second panel including a moisture vapor transmissive second hydrophobic microporous membrane, said second panel characterized by an air permeability of at least 6 CFM/ft$^2$ and a moisture vapor transmission rate of at least 1000 gm/m$^2$·day.

2. The garment of claim 1 wherein at least one of said microporous membranes comprises an expanded polytetrafluoroethylene (ePTFE) material.

3. The garment of claim 1 further including a fabric layer overlying at least one of said first and second films.

4. The garment of claim 1 wherein said second panel is characterized by an air permeability of at least 10 CFM/ft$^2$.

5. A garment for inhibiting relatively moving air from contacting a portion of a person wearing said garment, said garment comprising:

a first panel for inhibiting relatively moving air from contacting a portion of the person, said first panel including:

a first fabric layer;

a second fabric layer; and a first membrane disposed between said first and second fabric layers, said first membrane being water-resistant;

said first panel characterized by an air permeability of not more than 3 CFM/ft$^2$ and a moisture vapor transmission rate of at least 800 gm/m$^2$·day; and a second panel connectable with said first panel, said second panel including:

a third fabric layer;

a fourth fabric layer; and a second membrane disposed between said third and fourth fabric layers, said second membrane being water-resistant;

said second panel characterized by an air permeability of at least 6 CFM/ft$^2$ and a moisture vapor transmission rate of at least 1000 gm/m$^2$·day.

6. The garment of claim 5 wherein at least one of said first and second membranes is microporous and hydrophobic.

7. The garment of claim 5 wherein at least one of said first and second membranes is made from an expanded PTFE material.

8. The garment of claim 5 wherein at least one of said first and second fabric layers is attached to said first membrane.

9. The garment of claim 5 wherein at least one of said third and fourth fabric layers is attached to said second membrane.

10. The garment of claim 5 further including a pair of sides, said first panel being connected with said second panel in at least one location per side.

11. The garment of claim 10 wherein said first panel is connected with said second panel in at least two spaced apart locations per side.

12. A garment for inhibiting relatively moving air from contacting a portion of a person wearing said garment, said garment comprising:

a first panel for inhibiting air from contacting a portion of the person, said first panel including:

a first fabric layer;

a second fabric layer; and a first expanded polytetrafluoroethylene (ePTFE) membrane disposed between said first and second said first fabric layers, said first expanded polytetrafluoroethylene (ePTFE) membrane being water-resistant and having an air permeability of not more than 3 CFM/ft$^2$ and a moisture vapor transmission rate of at least 800 gm/m$^2$·day;

a second panel connected with said first panel in at least two locations, said second panel including:

a third fabric layer;

a fourth fabric layer;

a second expanded polytetrafluoroethylene (ePTFE) membrane disposed between said third and fourth fabric layers, said second expanded polytetrafluoroethylene (ePTFE) membrane being water-resistant and having an air permeability of at least 6 CFM/ft$^2$ and a moisture vapor transmission rate of at least 1000 gm/m$^2$·day.

13. The garment of claim 12 wherein at least one of said first and second expanded polytetrafluoroethylene (ePTFE) membranes has a moisture vapor transmission rate of at least 1200 gm/m$^2$·day.

14. The garment of claim 12 wherein at least one of said first and second fabric layers is attached to said first expanded polytetrafluoroethylene (ePTFE) membrane.

15. The garment of claim 12 wherein at least one of said third and fourth fabric layers is attached to said second expanded polytetrafluoroethylene (ePTFE) membrane.

16. The garment of claim 12 wherein said first panel is adapted to cover a portion of the front of a person wearing said garment.

17. The garment of claim 12 wherein said second panel is adapted to cover a portion of the back of a person wearing said garment.

18. The garment of claim 12 further including a pair of sides, said first panel being connected to said second panel in at least one location per side.

19. The garment of claim 18 further including a third panel disposed between and attached to said first and second panels in at least one location per side.

* * * * *